United States Patent [19]

McCormick

[11] 4,314,863

[45] Feb. 9, 1982

[54] STAINLESS STEEL CASTINGS

[75] Inventor: Jon McCormick, Thousand Oaks, Calif.

[73] Assignee: Fansteel Inc., North Chicago, Ill.

[21] Appl. No.: 89,980

[22] Filed: Oct. 31, 1979

[51] Int. Cl.[3] ..... C22C 38/42

[52] U.S. Cl. ..... 148/37; 75/125; 75/128 R; 148/38

[58] Field of Search ..... 75/128 G, 128 R, 125, 75/124; 148/37, 38

[56] References Cited

U.S. PATENT DOCUMENTS

| | | | |
|---|---|---|---|
| 2,784,083 | 3/1957 | Linnert et al. | 148/38 |
| 2,784,125 | 3/1957 | Clark, Jr. | 148/38 |
| 2,797,993 | 7/1957 | Tanczyn | 148/38 |
| 2,850,380 | 9/1958 | Clark, Jr. | 148/37 |
| 3,152,934 | 10/1964 | Lula et al. | 75/125 |
| 3,216,868 | 11/1965 | Nachtman | 148/136 |
| 3,352,666 | 11/1967 | Foster et al. | 148/37 |

*Primary Examiner*—Peter K. Skiff

*Attorney, Agent, or Firm*—Barnes, Kisselle, Raisch & Choate

[57] ABSTRACT

Stainless steel castings having an as-cast hardness of Rockwell B82 to 98, good ductility and high notch toughness, and consisting by weight of 13–19% of Cr, 2.0–3.6% of Ni and 2.0–3.5% of Cu with the sum of Ni plus Cu of at least 5.0%, 0.20–1.4% of Mn, 0.5–1.0% of Si, 0.035% max. of P, 0.035% max. of S, less than 0.10% of Mo, less than 0.10% of Cb, less than 0.10% of Al, 0.20–80% of C when the N is 0.05% max. and 0.10–60% C when the N is 0.05–0.10%, and balance essentially of Fe and any conventional impurities.

17 Claims, No Drawings

STAINLESS STEEL CASTINGS

FIELD OF INVENTION

Stainless steel castings, especially for intricate investment castings, which in the as-cast condition without any heat treatment provide moderate hardness in a narrow range, good ductility and notch toughness, and mechanical properties similar to those of forged medium carbon steels.

BACKGROUND OF THE INVENTION

Stainless steels are utilized extensively in a number of applications in the chemical, petrochemical, and energy fields, and their usage in these applications is continuing to increase. Stainless steel castings have been widely used in machines and equipment for pollution control, nuclear energy installations, refinery equipment, coke sintering, electrical power apparatus, chemical plants, food processing, marine-related equipment, and others.

Stainless steels also are used in some recreational products such as heads for golf club irons. Golf irons include club numbers 1 through 9, pitching and sand wedges, putters, chippers, and the like. Many of the stainless steel golf club heads are produced as investment castings to achieve intricate design configurations for improved playing performance. Stainless steel alloys used in investment-cast golf club heads usually are martensitic types, such as type 431, for example, or martensitic precipitation-hardenable grades, such as 17-4 PH, for example. Investment cast type 431 stainless steel golf club heads have a hardness of typically Rockwell C36-40 in the as-cast condition, and have a hardness of about Rockwell C23-25 after heat treatment for one hour at 1550° F., followed by slow cooling, then reheating for 1 to 1½ hours at 1250° F. These heat treatments produce essentially the minimum hardness that I have been able to achieve in investment cast type 431 golf club heads. Investment cast type 17-4 PH stainless steel golf club heads have a typical hardness of Rockwell C40-46 in the as-cast condition, and about Rockwell C32-35 after heat treatment for two hours at 1125°-1150° F., followed by air cooling. This heat treatment produces about the minimum hardness that I have been able to achieve in investment cast type 17-4 PH golf club heads.

Some stainless steel golf club heads, which are produced in either cast or forged form, are made from all-austenitic materials, such as an 18-8 or similar types, which have a low yield strength and hence tend to become bent by plastic deformation in play. Additionally, the austenitic materials are more highly alloyed and hence are more expensive to produce than golf club heads of the 431 and 17-4 PH types.

Some golfers have a preference for the "feel" or playing characteristics of forged carbon steels, such as a medium carbon AISI 1035 steel. These forged carbon steel golf club heads typically have a hardness of about Rockwell B90, although hardnesses as low as Rockwell B82-85 have been reported.

SUMMARY OF THE INVENTION

An objective of the present invention is to provide stainless steel castings in intricate forms such as golf club heads with generally complex configurations for superior playing characteristics, while also providing similar mechanical properties and the feel or response during play to those of forged carbon steel heads, and still retaining the excellent corrosion resistance and other benefits of a stainless steel alloy.

A further object is to provide an investment cast stainless steel alloy which uses minimum amounts of higher cost and more limited availability alloying elements required to achieve the desired combination of casting characteristics, hardness level and other mechanical properties, and corrosion resistance.

A further object is to provide an investment-cast stainless steel golf club head which possesses the desired hardness level and mechanical properties in the as-cast condition and does not require any supplemental heat treatment.

An additional object is to provide an investment cast stainless steel golf club head which possesses the desired hardness level to provide similar playing characteristics to those of forged carbon steel golf club heads, and also having in combination high ductility and notch impact strength for a cast material.

An additional object is to provide a cast golf club head that can be weld repaired without adversely affecting the properties of the material.

Other objects and advantages of this invention will be apparent in the following description and claims in which the invention is described in detail to enable a person skilled in the art to practice it, all in connection with the best mode presently contemplated for the invention.

According to the present invention, a stainless steel casting is provided consisting by weight percentage of 13-20% chromium, 2.0-3.6% nickel and 2.0-3.5% copper with the sum of nickel plus copper of at least 5.0%, 0.2-1.4% manganese, 0.5-1.0% silicon, 0.035% maximum phosphorus, 0.035% maximum sulfur, less than 0.10% molybdenum, less than 0.10% columbium, less than 0.10% aluminum, 0.20-0.80% carbon with 0.05% maximum nitrogen, or 0.10-0.60% carbon with 0.05-0.10% nitrogen, and the balance essentially iron and any conventional impurities.

DETAILED DESCRIPTION OF PREFERRED EMBODIMENT

A stainless steel casting, essentially that produced by investment casting, having a hardness in the as-cast condition in the range of Rockwell B82-98, and more particularly Rockwell B84-96, and desirably about Rockwell B90, and having chemical composition within closely controlled limits, to be described, has been found that also provides playing characteristics very similar to those of forged plain carbon steel golf club heads. This hardness level appears to be preferably achieved with a microstructure that contains a substantial portion of austenite in combination with some martensite or delta ferrite, or portions of all three of these phases, in order to achieve the desired hardness level along with high tensile ductility and V-notch Charpy impact strength in the castings in the as-cast condition. In some embodiments, the desired microstructure and mechanical properties are achieved by substantially higher levels of carbon content than utilized in all-austenitic materials, or in a martensitic alloy, such as type 431, or in a martensitic precipitation-hardenable alloy, such as type 17-4 PH. In such high carbon embodiments, significant amounts of carbides also are present as at least one additional phase in the microstructure.

According to the present invention, the alloying elements in the preferred chemical composition and their limits were established as shown in the examples which follow:

EXAMPLE 1

A series of principally 20-lb. induction melts was made of alloys with the chemical compositions listed in Table I. Rockwell hardness test data (average of at least 3 tests) determined on as-cast test bars of the alloys also are listed in Table I. Alloys 14 and 15 were duplicate runs to verify the reproducibility of the melting and test procedures, as were alloys 19 and 20. In some cases where tensile test bars and V-notch Charpy impact test bars were desired, 30-lb. melts were made. In other selected cases, three sets of different golf irons were cast to verify the desired casting characteristics and mechanical properties.

The induction melts were made in fused silica crucibles. The materials used in preparing the alloys included: carbon steel; iron-4% carbon shot when carbon additions were required; a 65% chromium content ferrochromium with low carbon and nitrogen contents when a low nitrogen content was desired, and a 5% nitrogen content ferrochromium when a high nitrogen content was desired; electrolytic nickel; 75% manganese content ferromanganese; 75% silicon content ferrosilicon; and copper bus bar stock. The metal was cast in silica shell investment molds to obtain test bars and golf club heads.

In order to keep the cost of the alloy to a minimum, elements such as molybdenum, columbium, titanium, tantalum, zirconium, and vanadium were intentionally not utilized, but generally some molybdenum and sometimes columbium were present as residuals in minor amounts of about 0.05% by weight. Elements such as tin and lead as well as other undesired elements suc as antimony, arsenic, boron, phosphorus, and sulphur were not added and were held to low levels to avoid their deleterious effects on properties. Aluminum also was held to <0.10% to minimize slag formation during melting and alumina-containing slag inclusions in the castings.

The data in Table I show that a Cr content of at least 13% was required to achieve the desired as-cast hardness of Rockwell B82–98 when the remainder of the alloy composition was 3.0% Ni, 3.0% Cu, 0.90% Mn, 0.75% Si, 0.35% C, 0.05% N, 0.015% P, 0.016% S, <0.10% Mo, <0.10% Al, and balance Fe as in alloys 1–8. In alloys with this same base composition, the desired hardness range was maintained in the as-cast material for Cr up to about 19%, the highest level examined. Alloys of higher Cr content were not investigated since a principal object of this invention is to achieve alloys having the desired hardness level in the as-cast condition while utilizing minimum costly or critical alloying elements.

The Cr equivalents of the alloys can be calculated from the weight percentage as:

$$\text{Cr eq.} = \text{Cr} + 2\text{Si} + \text{Mo}$$

With the above base composition, in alloys 3 through 8 the Cr equivalents are in the range of about 14.0 to 20.0, with about 16.3 as a typical value.

A carbon level of at least about 0.20% with up to 0.05% N was required to achieve the desired hardness range in the as-cast material as shown by the data for alloys 9–18. The desired hardness level was maintained for higher carbon contents up to about 0.80%, the highest level investigated. However, the amount of carbides present increases steadily as the carbon content is increased. The presence of such carbides improves the abrasion and wear resistance of the material, but makes machining more difficult, tends to lower corrosion resistance in some environments, and reduces ductility and especially notch toughness properties. Therefore, in a matrix composition of 15.0% Cr, 3.0% Ni, 3.0% Cu, 0.75% Mn, 0.75% Si, <0.05% N, 0.016% P, 0.016% S, <0.10% Mo, <0.10% Al and balance Fe, the C range of 0.20–0.50% is preferred, and especially the C range of 0.25–0.35% in order to achieve an alloy with a hardness in the desired range in the as-cast material in combination with good ductility and notch toughness.

Data on heats with nitrogen contents above 0.05% are shown as alloys 31–41 in Table I. The matrix composition was essentially about 3% Ni, 3% Cu, 0.6% Mn, 0.8% Si, 0.016% P, 0.02% S, 0.05% Mo, <0.10% Al, and balance essentially Fe, with the Cr contents varied in the range from about 15 to 19% and C contents from about 0.05 to 0.60%. The data show that hardness outside and above the desired range of Rockwell B82–98 occurred when the Cr was below about 16%, in combination with high nitrogen contents above about 0.09% and low C contents of about 0.15% or less. At higher Cr contents of about 16–17%, the desired hardness was achieved with N contents up to about 0.09% and C contents down to about 0.15%. At Cr contents of about 18% and higher, the as-cast hardness was near the optimum target of Rockwell B90 with N contents of about 0.05–0.06% and C contents of about 0.10–0.50%. Thus, when the nitrogen content of the alloy is in the range of about 0.05–0.10%, preferably the carbon content is in the range of about 0.10–0.60%.

As shown in the data for alloys 19–27, Mn contents ranging from 0.20–1.40% resulted in castings with as-cast hardness in the desired range of Rockwell B82–98 when the remainder of the alloy contained 15.0% Cr, 3.5% Ni, 3.3% Cu, 0.75% Si, 0.35% C, <0.05N, 0.014% P, 0.018% S, <0.10% Mo, <0.10% Al, and balance Fe.

Manganese is added to the alloy for several purposes. A portion of the manganese, along with a portion of the chromium, combines with sulfur present in the alloy to produce chromium-rich manganese sulfide and thereby avoids formation of other sulfides which would impair ductility of the alloy. Manganese also acts as a deoxidizer during refining. The residual manganese metal acts as an austenite stabilizing element.

The preferred manganese range in alloys of this invention appears to be about 0.50–1.40% when the above hardness data, sulfide combining characteristics and deoxidation considerations are taken into account.

One objection to using manganese as an alloying element is that a severe smoke of dense clouds of white oxides occurs when manganese metal is added to the molten bath because of vaporization of manganese and subsequent oxidation of the vapor. This effect increases in severity as the manganese content is increased; however, once the manganese metal is dissolved in the bath, there is no longer an appreciable smoke problem.

Silicon also serves as a deoxidizer during refining, and furthermore it improves the fluidity and castability of the molten metal. The preferred silicon range in alloys of this invention appears to be about 0.50–1.00%.

The above discussed alloys have a Ni content in the range of 2.5–3.6%, and also a Cu content of 2.5–3.5%. Alloys 28–30 show the effect of reducing either the Ni or the Cu content, or both, to a somewhat lower level of 2.0%, along with 15.2% Cr, 0.7% Mn, 0.8% Si, 0.25% C, <0.05% N, 0.017% P, 0.022% S, <0.05% Mo, <0.10% Al, and balance essentially Fe. These data show that the desired as-cast hardness was met with an alloy containing either 2.0% Ni and 3.0% Cu, or 3.0% Ni and 2.0% Cu. Therefore, the preferred Ni and Cu contents appear to be a range of about 2.0–3.5% for either element but with a minimum total Ni plus Cu of at least about 5.0%.

The precipitation hardening reaction in the martensitic precipitation-hardening 17–4 PH steel is attributed to precipitation of a copper-rich phase. By contrast, the function of the copper addition in as-cast alloys of this invention, which are not given a subsequent heat treatment, is for the different purpose of a lower cost substitute for some nickel. Without the copper addition, the nickel content would have to be increased, at a cost disadvantage, to stabilize a portion of the austenite in the as-cast material to obtain the desired hardness in the as-cast material.

Nickel also functions as an austenite stabilizer to aid in achieving the desired as-cast hardness, and it also is known to improve notch toughness and lower the ductile-to-brittle transition temperature of the steel.

The Ni equivalents of the alloys were calculated from the chemical composition weight percentages as:

$$\text{Ni eq.} = \text{Ni} + 0.5\text{Mn} = 0.5\text{Cu} = 30(\text{C} + \text{N})$$

The calculated Ni equivalents for alloys having the desired as-cast hardness range from about 8 minimum to 24 maximum in most cases.

To further illustrate the combined effects of Cr, Cu, Ni, and C, an additional series of heats designated Alloy No. 44–59 were made with Cr contents ranging from 12 to 18%, a constant Cu content of 3%, Ni contents ranging from 1 to 4%, and C contents ranging from 0.15 to 0.60% in a number of combinations. Other alloying elements and residuals were held at relatively constant levels in these heats: <1.0% Mn (nominally 0.75%); <1.0% Si (nominally 0.85%); <0.10% N (nominally 0.025%); and <0.035%, P, <0.035% S, <0.10% Mo, and <0.10% Al. The nominal chemical compositions and Rockwell hardness data determined on as-cast test bars of these alloys are listed in TABLE I, and calculated $Cr_{eq.}$ and $Ni_{eq.}$ values are shown in TABLE II. These data show that higher levels of Ni and C are required to achieve the desired as-cast hardness of Rockwell B82–98 when Cr is at lower levels of about 12 to 14% (see Alloy Nos. 46, 47, 49, 50 and 51); but when Cr is at higher levels, the Ni content can be as low as 1% when C is adequately high (Alloy No. 54), or alternatively when the Ni content is on the order of about 3% or higher, C content can be as low as about 0.15% (see Alloy No. 52).

EXAMPLE 2

Two 150-lb. induction melts were made of alloys designated P1 and P2. The melts were made in an alumina lined (about 98% $Al_2O_3$) furnace. The materials used in preparing the alloys included: carbon steel; iron-4% carbon shot; 65% chromium content ferrochromium with low carbon and nitrogen contents; electrolytic nickel; electrolytic manganese; 75% silicon content ferrosilicon; and copper bus bar stock. The metal was cast in silica shell investment molds to obtain test bars and golf club heads. The chemical compositions and hardness data are listed in Table III. The hardness data and magnetic test results along with calculated $Cr_{eq.}$ and $Ni_{eq.}$ values are shown in Table II. These alloys are considered to represent preferred embodiments of this invention. They demonstrate that essentially the optimum target as-cast hardness of Rockwell B90 ws achieved, and that larger melts can be readily and reproducibly made. Both alloys were non-magnetic.

Additional 150-lb. induction melts were made of alloys similar to P1 and P2 except the carbon content was held to about 0.25–0.30% by weight in order to reduce the amount of free carbides. These alloys also had an as-cast hardness of about Rockwell B90, and were non-magnetic.

An additional 150-lb. induction melt was made of an alloy similar to P-1 and P-2 except that additional electrolytic manganese metal was added to increase the manganese content to about 1.5% in about a 30-lb. aliquot of the melt of the alloy. This aliquot alloy was cast in silica shell investment molds to obtain test bars, and was designated as alloy No. 42. The chemical composition and as-cast hardness data are included in TABLE III.

An additional 30-lb. aliquot of the same 150-lb. melt was further doped with electrolytic manganese to increase the manganese content to about 2.0%. This heat was designated as alloy no. 43, for which chemical composition and as-cast hardness data are also listed in TABLE III. Both of the melts of alloys 42 and 43 showed severe smoke when the manganese was added to the melt. The hardness of these alloys fell slightly below the desired hardness range of Rockwell B82–98 of the criteria of this invention. These results support the finding of Example 1 that the preferred range of manganese of alloys of this invention should have an upper limit of about 1.40%.

Another factor appears to even further limit the maximum manganese content in alloys of this invention for certain applications. Surface defects, such as pits believed to be due to a reaction of the molten metal with the silica shell mold, begin to occur when the manganese content exceeds about 1.0%, and progressively become more severe as the manganese content is increased to higher levels. So even though the desired hardness range can be achieved with manganese contents up to about 1.40%, it is preferred to hold the manganese content to about 1.0% maximum in making investment castings where a smooth, essentially defect-free surface is desired, such as in golf club heads.

The chemical composition data in TABLE III show a columbium content of about 0.04–0.06%, which is believed to have resulted from a residual in the carbon steel or other material used in making the alloys. This small residual columbium content appears to have no significant influence on properties of the alloys.

EXAMPLE 3

The data on tensile properties in Table IV represent the average values for two or more as-cast test bars, and show that the alloys according to this invention having a hardness within the desired range of Rockwell B82–98 exhibit good elongation and reduction of area for material in the as-cast condition. This material also has a good tensile strength in the range of about 75,000 to 130,000 psi and a yield stress of about 40,000 to 90,000 psi.

The V-notch Charpy impact strength was in the range of about 33–83 ft.-lbs. for as-cast alloys of this invention. Alloy No. 4 is near the mid-range of hardness and also contains a substantial amount of carbides, yet exhibited an impact strength of about 50 ft.-lb. By comparison, the V-notch Charpy impact strength of type 431 cast and subsequently heat treated for 1 hr. at 1550° F., slow cooled, and reheated for 1½ hr. at 1250° F. was found to be 10–19 ft.-lbs.; and for type 17–4 PH cast and subsequently heat treated 2 hours at 1150° F. was 2–26 ft.-lbs. Thus, alloys of this invention have superior impact strength in the range of about 30 to 90 ft.-lbs, which is achieved in the as-cast condition without any subsequent heat treatment.

EXAMPLE 4

The golf club heads that were investment cast from alloys within the hardness and chemical compositional ranges of this invention were of excellent quality and showed good reproduction of the intricate head designs.

GTA (gas tungsten-arc) welds were made in areas on several of these cast heads to simulate weld repairs using filler metal of similar chemical composition. The resulting welds were sound, and the welds and adjacent weld area had a hardness of Rockwell B89, which was essentially the same as the hardness of Rockwell B88 to 90 in the base metal.

As-cast golf club heads of alloys of this invention were immersed in a 1% sodium chloride solution at ambient temperature. After 12 hrs. exposure, no rusting occurred; after 24 hrs. exposure, some small rust spots were observed. Under the same test conditions, conventionally heat treated type 431 golf club heads developed some rust spots during 12 hrs. exposure, whereas type 17–4 PH heat treated golf club heads did not; and after 24 hrs. exposure the type 431 heads showed more rust spots and the type 17–4 PH heads somewhat less than did as-cast heads of alloys of this invention.

Years of actual playing performance with types 431 and 17–4 PH stainless steel heads show no rusting on properly cleaned and passivated golf club heads. Thus, in view of similar corrosion resistance in the above corrosion tests, golf club heads of alloys of this invention should give similarly good corrosion resistance.

Magnetic tests were run on specimens from all of the alloys investigated using a hand held horseshoe magnet. The comparative degrees of ferromagnetism are listed in TABLE II, and show that the desired hardness was achieved in alloys ranging from non-magnetic in some cases up to magnetic strengths in other cases nearly equal to that of 431 and 17–4 PH stainless steels.

The microstructures and magnetic test data indicate that the as-cast alloys have carbides and austenite present and sometimes also martensite and delta ferrite phases. While not wishing to be bound by theory, I have speculated that the unique and unexpected behavior of the alloys of this invention may be due to: the synergetic effect of Ni, Cu, C and N on austenite stabilization and subsequently partial transformation during solidification of the casting; the formation and presence of carbides; these above effects in combination with specific Cr equivalents; and the fact that the final material under consideration is a non-equilibrium, as-cast material.

TABLE I

CHEMICAL COMPOSITION AND ROCKWELL HARDNESS DATA FOR 20- AND 30-LB. HEATS

| Alloy | Chemical Composition, wt. % | | | | | | | | | | | Hardness |
|---|---|---|---|---|---|---|---|---|---|---|---|---|
| No. | Cr | Ni | Cu | Mn | Si | C | N | P | S | Mo | Al | Rockwell |
| 1 | 12.0 | 3.0 | 3.0 | 0.90 | 0.75 | 0.35 | <0.05 | 0.015 | 0.015 | <0.10 | 0.10 | C38 |
| 2 | 12.5 | 3.0 | 3.0 | .90 | .75 | .35 | <.05 | .015 | .015 | <.10 | <.10 | C34 |
| 3 | 13.0 | 3.0 | 3.0 | .90 | .75 | .35 | <.05 | .015 | .015 | <.10 | <.10 | B90 |
| 4 | 14.0 | 3.0 | 3.0 | .90 | .75 | .35 | <.05 | .015 | .015 | <.10 | <.10 | B88 |
| 5 | 15.0 | 3.0 | 3.0 | .90 | .75 | .35 | <.05 | .015 | .015 | <.10 | <.10 | B86 |
| 6 | 16.0 | 3.0 | 3.0 | .90 | .75 | .35 | <.05 | .015 | .015 | <.10 | <.10 | B84 |
| 7 | 17.0 | 3.0 | 3.0 | .90 | .75 | .35 | <.05 | .015 | .015 | <.10 | <.10 | B85 |
| 8 | 18.0 | 3.0 | 3.0 | .90 | .75 | .35 | <.05 | .015 | .015 | <.10 | <.10 | B88 |
| 9 | 15.0 | 3.0 | 3.0 | .75 | .75 | .20 | <.05 | .016 | .016 | <.10 | <.10 | C38 |
| 10 | 15.0 | 3.0 | 3.0 | .75 | .75 | .25 | <.05 | .016 | .016 | <.10 | <.10 | B90 |
| 11 | 15.0 | 3.0 | 3.0 | .75 | .75 | .30 | <.05 | .016 | .016 | <.10 | <.10 | B85 |
| 12 | 15.0 | 3.0 | 3.0 | .75 | .75 | .35 | <.05 | .016 | .016 | <.10 | <.10 | B85 |
| 13 | 15.0 | 3.0 | 3.0 | .75 | .75 | .40 | <.05 | .016 | .016 | <.10 | <.10 | B86 |
| 14 | 15.0 | 3.0 | 3.0 | .75 | .75 | .50 | <.05 | .016 | .016 | <.10 | <.10 | B86 |
| 15 | 15.0 | 3.0 | 3.0 | .75 | .75 | .50 | <.05 | .016 | .016 | <.10 | <.10 | B87 |
| 16 | 15.0 | 3.0 | 3.0 | .75 | .75 | .60 | <.05 | .016 | .016 | <.10 | <.10 | B92 |
| 17 | 15.0 | 3.0 | 3.0 | .75 | .75 | .75 | <.05 | .016 | .016 | <.10 | <.10 | B95 |
| 18 | 15.0 | 3.0 | 3.0 | .75 | .75 | .80 | <.05 | .016 | .016 | <.10 | <.10 | B97 |
| 19 | 15.0 | 3.5 | 3.3 | .20 | .75 | .35 | <.05 | .014 | .018 | <.10 | <.10 | B88 |
| 20 | 15.0 | 3.5 | 3.3 | .20 | .75 | .35 | <.05 | .014 | .018 | <.10 | <.10 | B86 |
| 21 | 15.0 | 3.5 | 3.3 | .45 | .75 | .35 | <.05 | .014 | .018 | <.10 | <.10 | B85 |
| 22 | 15.0 | 3.5 | 3.3 | .60 | .75 | .35 | <.05 | .014 | .018 | <.10 | <.10 | B98 |
| 23 | 15.0 | 3.5 | 3.3 | .65 | .75 | .35 | <.05 | .014 | .018 | <.10 | <.10 | B82 |
| 24 | 15.0 | 3.5 | 3.3 | .80 | .75 | .35 | <.05 | .014 | .018 | <.10 | <.10 | B86 |
| 25 | 15.0 | 3.5 | 3.3 | .95 | .75 | .35 | <.05 | .014 | .018 | <.10 | <.10 | B84 |
| 26 | 15.0 | 3.5 | 3.3 | 1.10 | .75 | .35 | <.05 | .014 | .018 | <.10 | <.10 | B86 |
| 27 | 15.0 | 3.5 | 3.3 | 1.40 | .75 | .35 | <.05 | .014 | .018 | <.10 | <.10 | B84 |
| 28 | 15.2 | 2.0 | 3.0 | .70 | .80 | .25 | <.05 | .017 | .022 | <.05 | <.10 | B98 |
| 29 | 15.2 | 3.0 | 2.0 | .70 | .80 | .25 | <.05 | .017 | .022 | <.05 | <.10 | B96 |
| 30 | 15.2 | 2.0 | 2.0 | .70 | .80 | .25 | <.05 | .017 | .022 | <.05 | <.10 | C37 |

| Alloy | Chemical Composition, wt. % | | | | | | | | | | | As-Cast Hardness, |
|---|---|---|---|---|---|---|---|---|---|---|---|---|
| No. | Cr | Ni | Cu | Mn | Si | C | N | P | S | Mo | Al | Rockwell |
| 31 | 17.12 | 2.91 | 2.99 | .65 | .89 | .15 | .096 | .016 | .012 | .05 | <.10 | B88 |
| 32 | 17.03 | 2.86 | 2.96 | .70 | .88 | .16 | .108 | .016 | .012 | .05 | <.10 | B87 |
| 33 | 15.68 | 2.90 | 2.99 | .70 | .90 | .15 | .131 | .016 | .021 | .04 | <.10 | C39 |

TABLE I-continued

CHEMICAL COMPOSITION AND ROCKWELL HARDNESS DATA FOR 20- AND 30-LB. HEATS

| | | | | | | | | | | | | |
|---|---|---|---|---|---|---|---|---|---|---|---|---|
| 34 | 15.55 | 2.95 | 3.04 | .60 | .88 | .10 | .095 | .016 | .020 | .05 | <.10 | C40 |
| 35 | 15.69 | 2.97 | 3.04 | .54 | .83 | .05 | .091 | .016 | .019 | .05 | <.10 | C39 |
| 36 | 15.43 | 2.91 | 2.98 | .55 | .87 | .56 | .090 | .016 | .018 | .04 | <.10 | B91 |
| 37 | 18.85 | 2.90 | 3.01 | .61 | .83 | .50 | .061 | .016 | .018 | .05 | <.10 | B89 |
| 38 | 18.64 | 2.96 | 2.98 | .61 | .84 | .11 | .051 | .016 | .019 | .06 | <.10 | B90 |
| 39 | 16.62 | 3.21 | 3.22 | .65 | .86 | .22 | .043 | .016 | .011 | .06 | <.10 | B84 |
| 40 | 16.39 | 2.89 | 2.95 | .63 | .84 | .14 | .088 | .017 | .023 | .05 | <.10 | B84 |
| 41 | 16.97 | 2.67 | 3.04 | .77 | .81 | .33 | .066 | .016 | .017 | .05 | <.10 | B85 |
| 44 | 12.0 | 1.0 | 3.0 | .75 | .85 | .15 | <.10 | <.035 | <.035 | <.10 | <.10 | C43.3 |
| 45 | 12.0 | 2.0 | 3.0 | .75 | .85 | .30 | <.10 | <.035 | <.035 | <.10 | <.10 | C37.6 |
| 46 | 12.0 | 3.0 | 3.0 | .75 | .85 | .45 | <.10 | <.035 | <.035 | <.10 | <.10 | B92.7 |
| 47 | 12.0 | 4.0 | 3.0 | .75 | .85 | .60 | <.10 | <.035 | <.035 | <.10 | <.10 | B92.9 |
| 48 | 14.0 | 2.0 | 3.0 | .75 | .85 | .15 | <.10 | <.035 | <.035 | <.10 | <.10 | C44.8 |
| 49 | 14.0 | 3.0 | 3.0 | .75 | .85 | .30 | <.10 | <.035 | <.035 | <.10 | <.10 | B88.4 |
| 50 | 14.0 | 4.0 | 3.0 | .75 | .85 | .45 | <.10 | <.035 | <.035 | <.10 | <.10 | B90.2 |
| 51 | 14.0 | 1.0 | 3.0 | .75 | .85 | .60 | <.10 | <.035 | <.035 | <.10 | <.10 | B96.1 |
| 52 | 16.0 | 3.0 | 3.0 | .75 | .85 | .15 | <.10 | <.035 | <.035 | <.10 | <.10 | B92.8 |
| 53 | 16.0 | 4.0 | 3.0 | .75 | .85 | .30 | <.10 | <.035 | <.035 | <.10 | <.10 | B87 |
| 54 | 16.0 | 1.0 | 3.0 | .75 | .85 | .45 | <.10 | <.035 | <.035 | <.10 | <.10 | B93.3 |
| 55 | 16.0 | 2.0 | 3.0 | .75 | .85 | .60 | <.10 | <.035 | <.035 | <.10 | <.10 | B97.5 |
| 56 | 18.0 | 4.0 | 3.0 | .75 | .85 | .15 | <.10 | <.035 | <.035 | <.10 | <.10 | B90.1 |
| 57 | 18.0 | 1.0 | 3.0 | .75 | .85 | .30 | <.10 | <.035 | <.035 | <.10 | <.10 | B92.9 |
| 58 | 18.0 | 2.0 | 3.0 | .75 | .85 | .45 | <.10 | <.035 | <.035 | <.10 | <.10 | B94.4 |
| 59 | 18.0 | 3.0 | 3.0 | .75 | .85 | .60 | <.10 | <.035 | <.035 | <.10 | <.10 | B94.6 |

TABLE II

CALCULATED CHROMIUM AND NICKEL EQUIVALENTS, HARDNESS VALUES, AND MAGNETIC TEST DATA FOR INVESTMENT CAST HEATS

| Alloy No. | $Cr_{eq.}$ | $Ni_{eq.}$ | Hardness, Rockwell | Magnetic Test** |
|---|---|---|---|---|
| 1 | 13.92 | 8.06 | C38 | M(1) |
| 2 | 13.72 | 9.57 | C34 | M(2) |
| 3 | 14.56 | 10.16 | B90 | S(3) |
| 4 | 15.76 | 9.61 | B88 | VS(4) |
| 5 | 16.51 | 8.36 | B86 | VS(5) |
| 6 | 17.67 | 8.76 | B84 | N |
| 7 | 17.98 | 9.18 | B85 | N |
| 8 | 20.06 | 8.75 | B88 | VS(6) |
| 9 | 15.94 | 5.72 | C38 | M(1) |
| 10 | 15.83 | 7.82 | B90 | M(2) |
| 11 | 16.00 | 9.32 | B85 | N |
| 12 | 15.60 | 13.13 | B85 | N |
| 13 | 15.80 | 9.89 | B86 | S(3) |
| 14 | 15.99 | 12.38 | B86 | N |
| 15 | 15.90 | 13.84 | B87 | N |
| 16 | 16.01 | 18.64 | B92 | N |
| 17 | 15.95 | 21.34 | B95 | VS(5) |
| 18 | 15.80 | 27.36 | B97 | VS(4) |
| 19 | 15.89 | 8.02 | B88 | S(2) |
| 20 | 15.95 | 9.18 | B86 | VS(3) |
| 21 | 15.86 | 9.56 | B85 | CS(4) |
| 22 | 15.30 | 7.48 | B98 | M(1) |
| 23 | 16.56 | 9.45 | B82 | VS(5) |
| 24 | 15.88 | 10.35 | B86 | VS(6) |
| 25 | 17.05 | 10.59 | B84 | N |
| 26 | 15.98 | 10.68 | B86 | N |
| 27 | 15.94 | 11.44 | B84 | N |
| 28 | 16.57 | 6.86 | B98 | M(2) |
| 29 | 16.52 | 7.81 | B96 | (M3) |
| 30 | 15.64 | 7.21 | C37 | M(1) |
| 31 | 18.97 | 7.74 | B88 | S |
| 32 | 18.87 | 8.01 | B87 | VS |
| 33 | 17.54 | 7.75 | C38 | M(3) |
| 34 | 17.36 | 10.62 | C40 | M(5) |
| 35 | 17.40 | 8.99 | C39 | M(3) |

TABLE II-continued

CALCULATED CHROMIUM AND NICKEL EQUIVALENTS, HARDNESS VALUES, AND MAGNETIC TEST DATA FOR INVESTMENT CAST HEATS

| Alloy No. | $Cr_{eq.}$ | $Ni_{eq.}$ | Hardness, Rockwell | Magnetic Test** |
|---|---|---|---|---|
| 36 | 17.21 | 24.18 | B91 | N |
| 37 | 20.56 | 21.54 | B89 | N |
| 38 | 20.38 | 9.58 | B90 | M(3) |
| 39 | | | B84 | |
| 40 | 18.14 | 7.40 | B84 | VS |
| 41 | 18.64 | 16.50 | B85 | N |
| 42 | 16.66 | 15.49 | B80–81 | N |
| 43 | 15.64 | 15.17 | B81–82 | N |
| 44 | 13.5 | 8.12 | C43.3 | — |
| 45 | 13.5 | 13.62 | C37.6 | — |
| 46 | 13.5 | 19.12 | B92.7 | — |
| 47 | 13.5 | 24.62 | B92.9 | — |
| 48 | 15.5 | 9.12 | C44.8 | — |
| 49 | 15.5 | 14.62 | B88.4 | — |
| 50 | 15.5 | 20.12 | B90.2 | — |
| 51 | 15.5 | 21.62 | B96.1 | — |
| 52 | 17.5 | 10.12 | B92.8 | — |
| 53 | 17.5 | 15.62 | B87 | — |
| 54 | 17.5 | 17.12 | B93.3 | — |
| 55 | 17.5 | 22.12 | B97.5 | — |
| 56 | 19.5 | 11.12 | B90.1 | — |
| 57 | 19.5 | 12.62 | B92.9 | — |
| 58 | 19.5 | 18.12 | B94.4 | — |
| 59 | 19.5 | 23.62 | B94.6 | — |
| P1 | 17.41 | 16.36 | B88–91 | N |
| P2 | 16.32 | 15.28 | B88–91 | N |
| 431 | 17.20 | 7.73 | C36–49* | M(1) |
| 17-4 PH | 16.61 | 8.18 | C40–46* | M(1) |

*Typical hardness as-cast.
**Legend for Magnetic Test:
M = magnetic
S = slightly magnetic
VS = very slightly magnetic
N = non-magnetic
1–6 = scale numbered in order of decreasing magnetic strength where 1 is strongest and 6 is weakest

TABLE III

CHEMICAL COMPOSITION AND ROCKWELL HARDNESS DATA

| Alloy No. | Chemical Composition, wt. % | | | | | | | | | | | | As-Cast Hardness, Rockwell |
|---|---|---|---|---|---|---|---|---|---|---|---|---|---|
| | Cr | Ni | Cu | Mn | Si | C | N | P | S | Mo | Cb | Al | |
| P1* | 15.78 | 2.64 | 2.56 | 0.46 | 0.79 | 0.37 | 0.037 | 0.016 | 0.021 | 0.05 | 0.06 | <.10 | B88–91 |
| P2* | 14.67 | 2.63 | 2.66 | .38 | .80 | .35 | .021 | .016 | .022 | .05 | .05 | <.10 | B88–91 |

TABLE III-continued

CHEMICAL COMPOSITION AND ROCKWELL HARDNESS DATA

| Alloy No. | Chemical Composition, wt. % | | | | | | | | | | | | As-Cast Hardness, Rockwell |
|---|---|---|---|---|---|---|---|---|---|---|---|---|---|
| | Cr | Ni | Cu | Mn | Si | C | N | P | S | Mo | Cb | Al | |
| 42** | 15.03 | 2.63 | 2.90 | 1.48 | .79 | .33 | .024 | .016 | .018 | .06 | .05 | <.10 | B80-81 |
| 43** | 14.00 | 2.65 | 2.89 | 2.05 | .79 | .30 | .035 | .016 | .018 | .06 | .04 | <.10 | B81-82 |

*150-lb. melt.
**30-lb. manganese-doped aliquot of a 150-lb. melt.

TABLE IV

MECHANICAL PROPERTY DATA FOR AS-CAST ALLOYS COMPARED TO HEAT TREATED 431 AND 17-4 PH CAST STAINLESS STEELS

| Alloy No. | Hardness, Rockwell | 0.2% Offset Yield Stress, psi | Tensile Strength, psi | Elongation, % in 1-in. | Red. in Area, % | Impact Strength, ft.-lb. |
|---|---|---|---|---|---|---|
| 1 | C38 | 107,500 | 110,500 | 1.8 | 5.8 | — |
| 4 | B88 | 48,000 | 85,500 | 7.5 | 8.6 | 49.7 |
| 6 | B84 | 51,500 | 78,500 | 15.8 | 19.8 | — |
| 9 | C38 | 149,000 | 152,500 | 2.0 | 5.5 | — |
| 10 | B90 | 85,000 | 117,000 | 5.0 | 8.0 | — |
| 11 | B85 | 48,000 | 84,000 | 9.0 | 13.0 | 49.7 |
| 12 | B85 | 58,000 | 84,000 | 16.0 | 20.0 | — |
| 13 | B86 | 52,000 | 90,000 | 10.0 | 12.0 | — |
| 14 | B86 | 56,000 | 84,000 | 16.0 | 20.0 | — |
| 31 | B88 | 44,600 | 110,500 | 12.0 | 11.2 | 57.0 |
| 32 | B87 | 47,000 | 97,800 | 12.7 | 12.2 | 83.0 |
| 40 | B84 | 44,800 | 117,000 | 9.5 | 12.1 | 32.8 |
| 42* | B80-81 | 52,000 | 88,000 | 24.0 | 19.0 | — |
| 43* | B81-82 | 51,500 | 92,500 | 24.0 | 26.2 | — |
| 431** | C23-25 | 70,900-96,200 | 95,000-212,000 | 15-23 | 46-62 | 10-19 |
| 17-4*** | C32-35 | 113,000-139,000 | 152,000-172,000 | 11-15 | 26-40 | 2-26 |

*30-lb. manganese-doped aliquot of a 150-lb. melt.
**Range of values for 2 production heats of type 431 investment cast stainless steel heat treated 1 hr. at 1550° F., slow cooled, reheated 1.5 hr. at 1250° F.
***Range of values for 6 production heats of type 17-4 PH investment cast stainless steel heat treated 2 hrs. at 1150°F., air cooled.

I claim:

1. A cast stainless steel in the as-cast condition having a hardness in the range of 82 to 98 on the Rockwell "B" scale and a V-notch Charpy impact strength of at least about 30 ft.-lbs., and consisting essentially by weight of about 13-19% Cr, 2.0-3.6% Ni and 2.0-3.5% Cu with Ni plus Cu at least 5.0%, 0.2-1.4% Mn, 0.5-1.0% Si, 0.035% max P, 0.035% max. S, 0.1% max. Mo, 0.1% max. Cb, 0.1% max. Al, 0.20-0.80% C when N is about 0.05% max. and 0.10-0.60% C when N is 0.05-0.10%, with the balance essentially Fe and any conventional impurities.

2. A cast stainless steel according to claim 1 wherein the Cr equivalent is about 14 to 20.

3. A cast stainless steel according to claim 1 wherein the Cr equivalent is about 16 to 19.

4. A cast stainless steel according to claim 1 which as-cast has a microstructure comprising essentially austenite and a second metallic phase selected from martensite and delta ferrite.

5. A cast stainless steel according to claim 4 which as-cast also contains a carbide phase in said microstructure.

6. A cast stainless steel according to claim 1 wherein as-cast said hardness is in the range of 84 to 96 on the Rockwell "B" scale.

7. A cast stainless steel according to claim 1 in which as-cast said hardness is about 90 on the Rockwell "B" scale.

8. A cast stainless steel according to claim 1 wherein said C is in the range of 0.20-0.50%.

9. A cast stainless steel according to claim 1 wherein said C is in the range of 0.25-0.35%.

10. A cast stainless steel in the as-cast condition having a hardness of 82 to 98 on the Rockwell "B"scale and a V-notch Charpy impact strength of at least about 30 ft.-lbs, and consisting essentially by weight percentage of about 15 Cr, 3 Ni, 3 Cu, 0.75 Mn, 0.75 Si, 0.35 C, 0.05 N, 0.015 P, 0.015 S, less than 0.10 Mo, less than 0.10 Cb, less than 0.10 Al, and the remainder essentially Fe and any conventional impurities.

11. A cast stainless steel golf club head in the as-cast condition having a hardness in the range of 82 to 98 on the Rockwell "B" scale and consisting essentially by weight of about 13-20% Cr, 2.0-3.6% Ni, and 2.0-3.5% Cu, with Ni plus Cu at least 5.0%, 0.2-1.4% Mn, 0.5-1.0% Si, 0.035% max. P, 0.035% max. S, 0.1% max. Mo, 0.1% max. Cb, 0.1% max. Al, 0.20-0.80% C when N is 0.05% max. and 0.10-0.60% C when N is 0.05-0.10%, with the balance essentially Fe and any conventional impurities.

12. A golf club head according to claim 11 wherein said head is investment cast.

13. An as-cast golf club head according to claim 11 wherein said C is in the range of 0.20-0.50%.

14. An as-cast golf club head according to claim 11 wherein said C is in the range of 0.25-0.35%.

15. A cast golf club head in the as-cast condition having a hardness of 82 to 98 on the Rockwell "B" scale and consisting by weight of about 14.0 to 16.5% Cr, 2.0 to 3.5% Ni, 2.0 to 3.5% Cu, 0.2 to 1.0% Mn, 0.5 to 1.0% Si, 0.25 to 0.45% C, 0.1% max. N, 0.035% max. P, 0.035% max. S, 0.1% max. Mo, 0.1% max. Cb, 0.1% mx. Al, and the balance essentially Fe and any conventional impurities.

16. A cast golf club head in the as-cast condition having a hardness of 82 to 98 on the Rockwell "B" scale and consisting by weight of about 14.0 to 16.5% Cr, 1.0 to 4.0% Ni, 2.0 to 3.5% Cu, 0.2 to 1.0% Mn, 0.5 to 1.0% Si, 0.35 to 0.80% C, 0.10% max. N, 0.035% max. P, 0.035% max. S, 0.1% max. Mo, 0.1% max. Cb, 0.1% max. Al, and the balance essentially Fe and any conventional impurities.

17. A cast golf club head in the as-cast condition having a hardness of 82 to 98 on the Rockwell "B" scale and consisting essentially by weight of about 15.5 to 18.5% Cr, 2.0 to 4.0% Ni, 2.0 to 3.5% Cu, 0.2 to 1.0% Mn, 0.5-1.0% Si, 0.10 to 0.80% C, 0.05% max. N, 0.035% max. P, 0.035% max. S, 0.1% max. Mo, 0.1% max. Cb, 0.1% max. Al, and balance Fe and any conventional impurities.

* * * * *